US008040294B2

(12) United States Patent
Kim

(10) Patent No.: US 8,040,294 B2
(45) Date of Patent: Oct. 18, 2011

(54) PLASMA DISPLAY APPARATUS

(75) Inventor: Suk-Ki Kim, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 975 days.

(21) Appl. No.: 11/984,416

(22) Filed: Nov. 16, 2007

(65) Prior Publication Data

US 2008/0117135 A1 May 22, 2008

(30) Foreign Application Priority Data

Nov. 21, 2006 (KR) ..... 10-2006-0115453

(51) Int. Cl.
*G09G 3/28* (2006.01)

(52) U.S. Cl. ..... 345/60; 345/68

(58) Field of Classification Search ..... 345/60, 345/68

See application file for complete search history.

(56) References Cited

U.S. PATENT DOCUMENTS 6,008,687 A * 12/1999 Orita et al. ..... 327/515
2004/0212562 A1* 10/2004 Kim et al. ..... 345/60
2005/0093782 A1* 5/2005 Lee ..... 345/68
2006/0109214 A1* 5/2006 Cho et al. ..... 345/68
2006/0262045 A1* 11/2006 Park ..... 345/68

FOREIGN PATENT DOCUMENTS

KR 1020050098032 * 11/2006

* cited by examiner

*Primary Examiner* — Quan-Zhen Wang
*Assistant Examiner* — Troy Dalrymple
(74) *Attorney, Agent, or Firm* — Robert E. Bushnell, Esq.

(57) ABSTRACT

A plasma display apparatus includes: an electrode of a discharge cell; a first transistor having a first terminal and a second terminal, the second terminal being connected to the electrode; a first capacitor having a first terminal to receive a control signal having either a low level voltage or a high level voltage; a push-pull circuit including a first power terminal, a second power terminal connected to the first terminal of the first transistor, an input terminal connected to a second terminal of the first capacitor, and an output terminal connected to a gate of the first transistor, the push-pull circuit outputting either a voltage of the first power terminal or a voltage of the second power terminal to the output terminal; a floating power source having a positive terminal connected to the first power terminal and a negative terminal connected to the second power terminal; and a first diode connected between the first terminal of the first transistor and the second terminal of the first capacitor.

21 Claims, 8 Drawing Sheets

PLASMA DISPLAY APPARATUS

CLAIM OF PRIORITY

This application makes reference to, incorporates the same herein, and claims all benefits accruing under 35 U.S.C. §119 from an application for PLASMA DISPLAY APPARATUS earlier filed in the Korean Intellectual Property Office on the 21 day of Nov. 2006 and there duly assigned Serial No. 10-2006-0115453.

BACKGROUND OF THE INVENTION

1. Field of the Invention

The present invention relates to a plasma display apparatus and, more particularly, the present invention relates to a gate driving circuit of an energy recovery circuit of a plasma display apparatus.

2. Description of the Related Art

Plasma display apparatuses display a letter or an image using a plasma generated by a gas discharge. Plasma display apparatuses are generally driven by dividing a frame into a plurality of sub-fields. Each sub-field includes an address period and a sustain period. Luminescent cells and non-luminescent cells are divided during an address period of each sub-field, and a sustain discharge occurs in luminescent cells in order to display an image during a sustain period.

Plasma display apparatuses use an energy recovery circuit in order to supply a sustain discharge pulse to electrodes during the sustain period. The energy recovery circuit turns on a transistor connected between an inductor connected to electrodes and an energy recovery capacitor and generates a resonance between the electrodes and inductor. A gate driving circuit having a bypass capacitor can be used to drive the transistor.

However, plasma display apparatuses comprise a large heatsink due to a heat dissipation problem. The heatsink can increase the length of a conductive pattern that connects the bypass capacitor and a gate of the transistor. The heatsink also can increase a parasitic component formed in the conductive pattern. The parasitic component causes a drop in voltage, which reduces the voltage of the bypass capacitor resulting in a reduced voltage being supplied to the gate of the transistor.

The voltage of the bypass capacitor is not properly boosted due to the parasitic component formed on the bypass capacitor, which can reduce a voltage supplied to the gate of the transistor and thus the transistor cannot be properly turned on. In this case, since the energy recovery circuit is not operated, plasma display apparatuses generate a lot of heat, which can damage elements.

SUMMARY OF THE INVENTION

The present invention provides a gate drive circuit capable of preventing a malfunction in an energy recovery circuit of a plasma display apparatus using serially connected Zener diodes having an opposite polarity in order to supply a floating power source to a push-pull circuit of the gate drive circuit of the energy recovery circuit.

According to one aspect of the present invention, a plasma display apparatus is provided including: an electrode of a discharge cell; a first transistor having a first terminal and a second terminal, the second terminal being connected to the electrode; a first capacitor having a first terminal to receive a control signal having either a low level voltage or a high level voltage; a push-pull circuit including a first power terminal, a second power terminal connected to the first terminal of the first transistor, an input terminal connected to a second terminal of the first capacitor, and an output terminal connected to a gate of the first transistor, the push-pull circuit outputting either a voltage of the first power terminal or a voltage of the second power terminal to the output terminal; a floating power source having a positive terminal connected to the first power terminal and a negative terminal connected to the second power terminal; and a first diode connected between the first terminal of the first transistor and the second terminal of the first capacitor.

The plasma display apparatus preferably further includes a second diode serially connected to the first diode in an opposite direction to the first diode, the second diode being a Zener diode. The first diode is preferably a Zener diode.

An anode of the first diode is preferably connected to the first terminal of the first transistor, a cathode of the first diode is connected to a cathode of the second diode, and an anode of the second diode is connected to the second terminal of the first capacitor.

The plasma display apparatus preferably further includes: a first resistor connected between the output terminal of the push-pull circuit and the gate of the first transistor; a second resistor connected between the second terminal of the first capacitor and the first terminal of the first transistor; and a third resistor connected between the first terminal of the first capacitor and a ground terminal.

The push-pull circuit preferably includes: an npn type transistor including a collector connected to the first power terminal, an emitter connected to the output terminal, and a base connected to the input terminal; and a pnp type transistor including a collector connected to the second power terminal, an emitter connected to the output terminal, and a base connected to the input terminal.

The first transistor is preferably an Insulated Gate Bipolar Transistor (IGBT) and the first terminal of the first transistor is an emitter. The first transistor is alternatively preferably a Field Effect Transistor (FET), and the first terminal of the first transistor is a source.

The plasma display apparatus preferably further includes: a second capacitor connected to the first terminal of the first transistor; an inductor connected between the electrode and the second terminal of the first transistor; a second transistor having a first terminal connected to the inductor and a second terminal connected to the second capacitor; a third transistor connected between the electrode and a first power source, the first power source supplying a first voltage; and a fourth transistor connected between the electrode and a second power source, the second power source supplying a second voltage lower than the first voltage.

According to another aspect of the present invention, a plasma display apparatus is provided including: an electrode of a discharge cell; a first transistor having a second terminal connected to the electrode; a first capacitor having a first terminal to receive a control signal having either a low level voltage or a high level voltage; a push-pull circuit including a first power terminal, a second power terminal connected to a first terminal of the first transistor, an input terminal connected to a second terminal of the first capacitor, and an output terminal connected to a gate of the first transistor, the push-pull circuit outputting either a voltage of the first power terminal or the second power terminal at the output terminal; a floating power source having a positive terminal connected to the first power terminal and a negative terminal connected to the second power terminal; a first diode connected between the first terminal of the first transistor and the second terminal of the first capacitor; an inductor connected between the electrode and the second terminal of the first transistor; a second transistor having a first terminal connected to the inductor and a second terminal connected to the first capacitor; and a third capacitor having a first terminal connected to a third power source and a second terminal connected to the first terminal of the second transistor, the third power source supplying a third voltage.

The plasma display apparatus preferably further includes a second diode serially connected to the first diode in an opposite polarity to the first diode, the second diode being a Zener diode. The first diode is preferably a Zener diode.

The floating power source preferably includes a fourth capacitor having a first terminal connected to the second power terminal and a second terminal connected to the first power terminal and the first terminal of the third capacitor.

An anode of the first diode is preferably connected to the first terminal of the first transistor, a cathode of the first diode is connected to a cathode of the second diode, and an anode of the second diode is connected to the second terminal of the first capacitor.

The plasma display apparatus preferably further includes: a first resistor connected between the output terminal of the push-pull circuit and the gate of the first transistor; a second resistor connected between the second terminal of the first capacitor and the first terminal of the first transistor; and a third resistor connected between the first terminal of the first capacitor and a ground terminal.

The push-pull circuit preferably includes: an npn type transistor including a collector connected to the first power terminal, an emitter connected to the output terminal, and a base connected to the input terminal; and a pnp type transistor including a collector connected to the second power terminal, an emitter connected to the output terminal, and a base connected to the input terminal.

The first transistor is preferably an Insulated Gate Bipolar Transistor (IGBT) and the first terminal of the first transistor is an emitter. The first transistor is alternatively preferably a Field Effect Transistor (FET) and the first terminal of the first transistor is a source.

The plasma display apparatus preferably further includes: a second capacitor connected to the first terminal of the first transistor; a third transistor connected between the electrode and a first power source, the first power source supplying a first voltage; and a fourth transistor between the electrode and a second power source, the second power source supplying a second voltage lower than the first voltage.

The plasma display apparatus preferably further includes: a second diode connected between a first terminal of the third transistor and a second terminal of the fourth transistor; and a third diode connected between a third power source and the first terminal of the third transistor.

The plasma display apparatus preferably further includes: a fourth diode having an anode connected to the inductor and a cathode connected to the second terminal of the first transistor; and a fifth diode having an anode connected to the first terminal of the second transistor and a cathode connected to the inductor.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
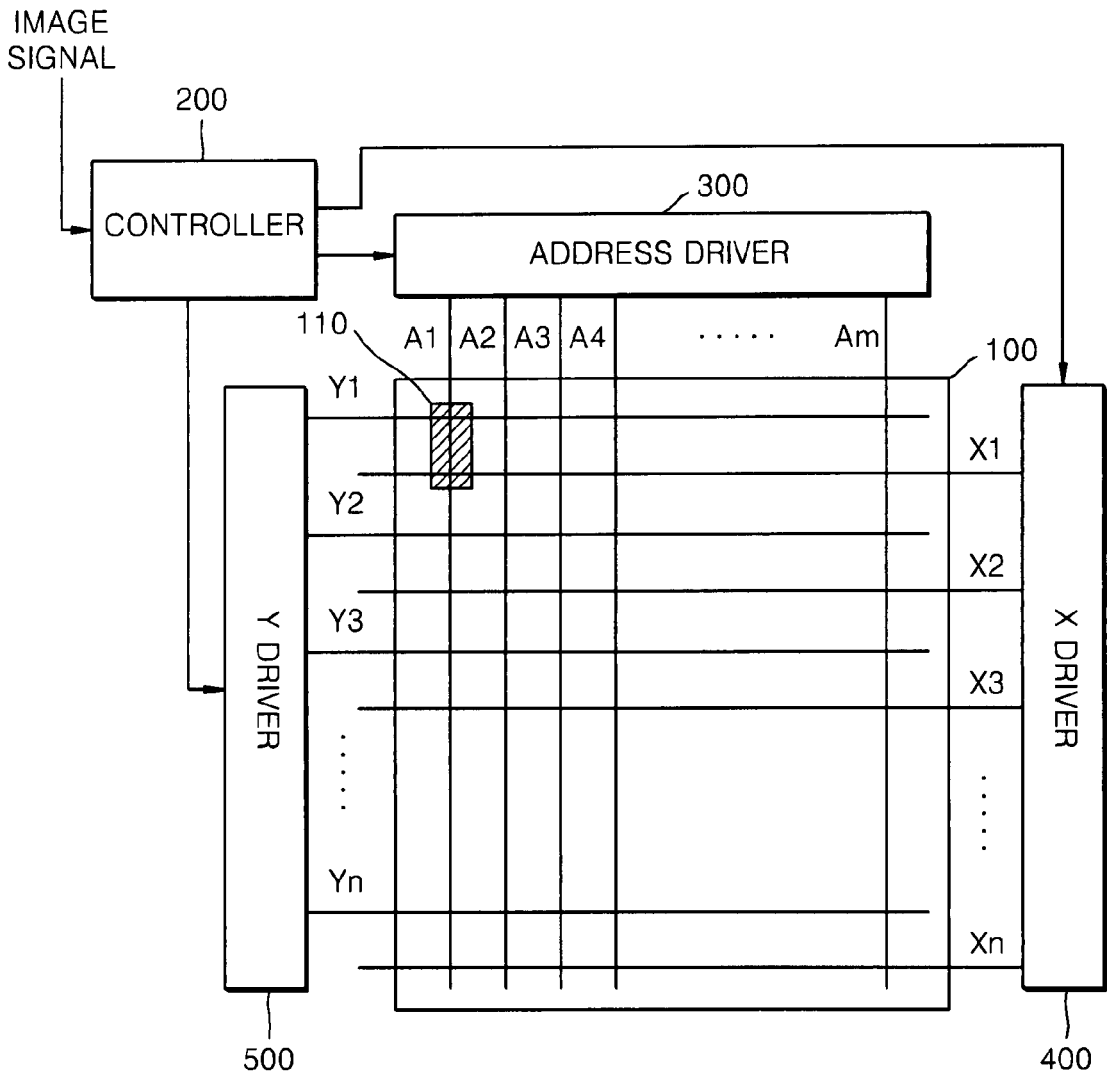
FIG. 1 is a block diagram of a plasma display apparatus according to an embodiment of the present invention.

The present invention will now be described more fully with reference to the accompanying drawings, in which exemplary embodiments of the present invention are shown. The present invention may, however, be embodied in many different forms and should not be construed as being limited to the embodiments set forth herein; rather, these embodiments are provided so that this disclosure will be thorough and complete, and will fully convey the concept of the present invention to those skilled in the art. Like reference numerals in the drawings denote like elements, and thus, repeated descriptions thereof have been omitted.

Throughout the specification, when a portion is "connected" to another portion, this means that the two portions are "directly connected" to each other and "electrically connected" when an element is disposed between the two portions. When a portion "comprises" a constituent, this means that the portion may further comprise another constituent unless expressly stated to the contrary.

The plasma display apparatus and apparatus for driving the same according to an embodiment of the present invention are described more fully below with reference to the accompanying drawings.

Figure 2:
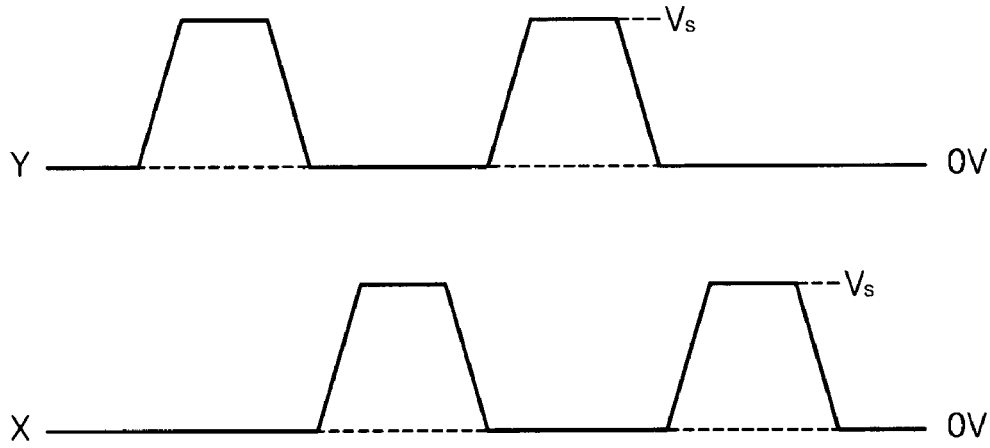
FIG. 2 includes waveforms of sustain discharge pulses according to an embodiment of the present invention.

FIG. 1 is a block diagram of a plasma display apparatus according to an embodiment of the present invention. FIG. 2 includes waveforms of sustain discharge pulses according to an embodiment of the present invention.

Referring to FIG. 1, the plasma display apparatus according to the present embodiment comprises a Plasma Display Panel (PDP) 100, a controller 200, an address driver 300, an X driver 400, and a Y driver 500.

The PDP 100 comprises a plurality of address electrodes (hereinafter referred to as "A electrodes") A1 to Am extending in a column, a plurality of pairs of sustain electrodes (hereinafter referred to as "X electrodes") X1 to Xn extending in a row, and a plurality of scan electrodes (hereinafter referred to as "Y electrodes") Y1 to Yn. The X electrodes X1 to Xn respectively correspond to the Y electrodes Y1 to Yn. The Y electrodes Y1 to Yn and the X electrodes X1 to Xn are perpendicular to the A electrodes A1 to Am. Discharge spaces where the A electrodes A1 to Am cross the Y electrodes Y1 to Yn and the X electrodes X1 to Xn form discharge cells 110.

The controller 200 receives an external image signal, outputs a drive control signal, and divides a frame into a plurality of sub-fields each having a brightness weight. Each sub-field includes an address period and a sustain period. The address driver 300, the X driver 400, and the Y driver 500 respectively supply a drive voltage to the A electrodes A1 to Am, the X electrodes X1 to Xn, and the Y electrodes Y1 to Yn, according to a drive control signal received from the controller 200.

In more detail, during an address period of each sub-field, the address driver 300, the X driver 400, and the Y driver 500 discriminate between luminescent cells and non-luminescent cells in each sub-field among the discharge cells 110. Referring to FIG. 2, during a sustain period of each sub-field, the X driver 400 supplies sustain discharge pulses alternately having a high level voltage Vs and a low level voltage 0 V to the X electrodes X1 to Xn by a number corresponding to a weight of each sub-field. The Y driver 500 supplies sustain discharge pulses having a sustain discharge pulse phase that is opposite to that supplied by the X driver 400 to the X electrodes X1 to Xn to the Y electrodes Y1 to Yn. A voltage difference between each of the X electrodes X1 to Xn and each of the Y electrodes Y1 to Yn is alternately a Vs voltage and a −Vs voltage. Therefore, a sustain discharge is repeatedly performed a predetermined number of times in a discharge cell that is to be turned on.

To the contrary, when 0V voltage is supplied to the X electrodes X1 to Xn, the Y driver 500 can supply sustain discharge pulses alternately having a Vs voltage and a −Vs voltage to the Y electrodes Y1 to Yn. In this case, the X driver 400 can be removed.

A sustain discharge circuit that supplies the sustain discharge pulses of FIG. 2 is described below in detail with reference to FIGS. 3 and 4.

Figure 3:
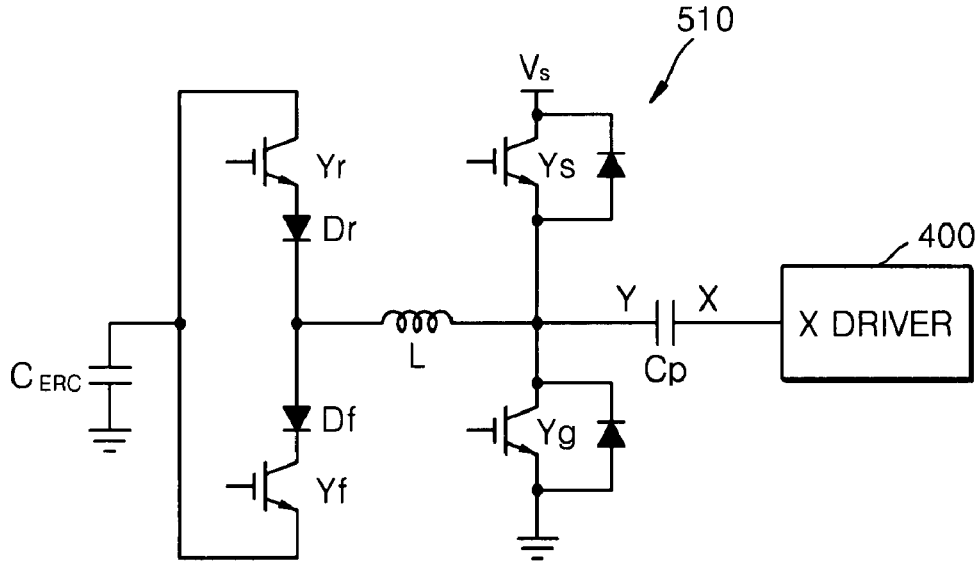
FIG. 3 is a circuit diagram of a sustain discharge circuit according to an embodiment of the present invention.

FIG. 3 is a circuit diagram of a sustain discharge circuit 510 according to an embodiment of the present invention. Referring to FIG. 3, the sustain discharge circuit 510 connected to the Y electrodes Y1 to Yn are illustrated for descriptive convenience. The sustain discharge circuit 510 can be formed in the Y driver 500 of FIG. 1. A sustain discharge circuit having the same structure as the sustain discharge circuit 510 can also be formed in the X driver 400.

The sustain discharge circuit 510 can be connected to all or some of the Y electrodes Y1 to Yn. For descriptive convenience, the sustain discharge circuit 510 includes an X electrode X and a Y electrode Y. A capacitive component formed by the X electrode X and the Y electrode Y is illustrated as a panel capacitor Cp.

The sustain discharge circuit 510 comprises an inductor L, transistors Ys, Yg, Yr, and Yf, and diodes Dr and Df. A body diode can be formed in the transistors Ys and Yg between an emitter and collector. Each of the transistors Ys, Yg, Yr, and Yf is an Insulated Gate Bipolar Transistor (IGBT) having a collector and an emitter as two terminals and having a gate used as a control terminal. However, another transistor such as a Field Effect Transistor (FET) having a drain and source as two terminals and having a gate used as the control terminal can also be used. Each of the transistors Ys, Yg, Yr, and Yf is a single transistor. However, each of the transistors Ys, Yg, Yr, and Yf can be a plurality of transistors connected in parallel.

In more detail, a collector of the transistor Ys is connected to power source supplying a high level voltage Vs, and an emitter of the transistor Ys is connected to the Y electrode Y. An emitter of the transistor Yg is connected to power source (i.e., a ground terminal) supplying a low level voltage 0V, and a collector of the transistor Yg is connected to the Y electrode Y. A first terminal of the inductor L is connected to the Y electrode Y, and the cathode of the diode Dr and the anode of the diode Df are connected to a second terminal of the inductor L. The emitter of the transistor Yr is connected to the anode of the diode Dr, and the collector of the transistor Yf is connected to the cathode of the diode Df. The collector of the transistor Yr and the emitter of the transistor Yf are connected to a capacitor Cerc that is an energy recovery power source. The capacitor Cerc supplies a voltage $V_{ERC}$ between the high level voltage Vs and the low level voltage 0V. In particular, the capacitor Cerc supplies an intermediate voltage Vs/2 of the two voltages Vs and 0V. The diode Dr sets a current path for increasing the voltage of the Y electrode Y. The diode Df sets a current path for reducing the voltage of the Y electrode Y.

The operation of the sustain discharge circuit 510 will now be described with reference to FIG. 4. FIG. 4 is a signal timing diagram of the sustain discharge circuit 510 of FIG. 3. It is assumed that the transistor Yg is turned on in modes 1 through 4 M1 through M4 so that 0V voltage is supplied to the Y electrode Y.

Figure 4:
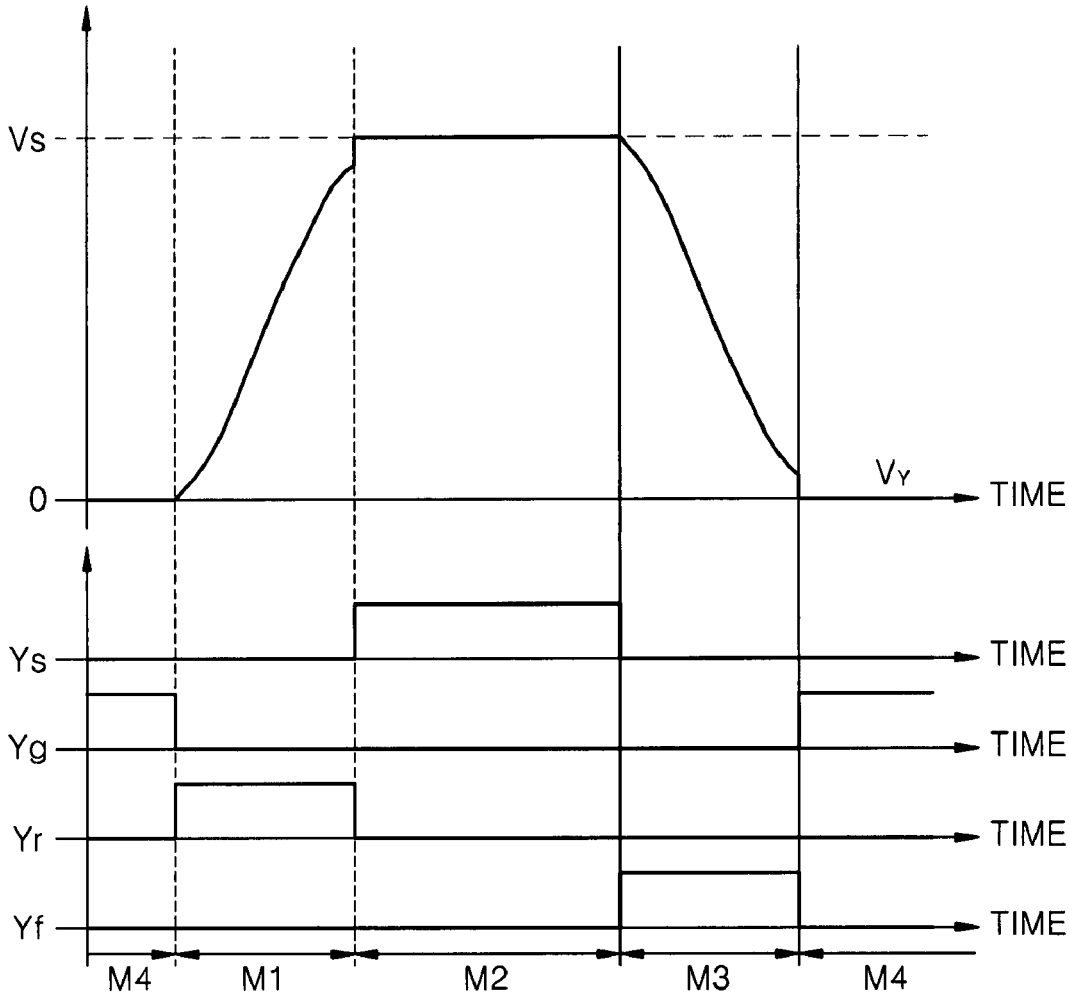
FIG. 4 is a signal timing diagram of the sustain discharge circuit of FIG. 3.

Referring to FIG. 4, the transistor Yr is turned on and the transistor Yg is turned off in the mode 1 M1. A resonance is generated via a path connecting the capacitor Cerc, the transistor Yr, the diode Dr, the inductor L, and a panel capacitor Cp so that the voltage of the Y electrode is increased. Thereafter, the transistor Ys is turned on and the transistor Yr is turned off in the mode 2 M2 so that the Vs voltage is supplied to the Y electrode Y.

The transistor Yf is turned on and the transistor Ys is turned off in the mode 3 M3. A resonance is generated via a path connecting the panel capacitor Cp, the inductor L, the diode Df, the transistor Yf, and the capacitor Cerc so that the voltage of the Y electrode is reduced. Thereafter, the transistor Yg is turned on and the transistor Yf is turned off in the mode 4 M4 so that 0V voltage is supplied to the Y electrode Y.

The sustain discharge circuit 510 repeats the operation of the modes 1 through 4 M1 through M4 during the sustain period a number of times corresponding to the weight of a sub-field so that the sustain discharge pulses alternately having the 0V voltage and the Vs voltage can be supplied to the Y electrode Y.

In this regard, a parasitic inductance between the capacitor Cerc and the transistors Yr and Yf of the sustain discharge circuit 510 can cause a malfunction in the sustain discharge circuit 510. The reason why the parasitic inductance causes the malfunction in the sustain discharge circuit 510 is described below with reference to FIGS. 5 through 9.

Figure 5:
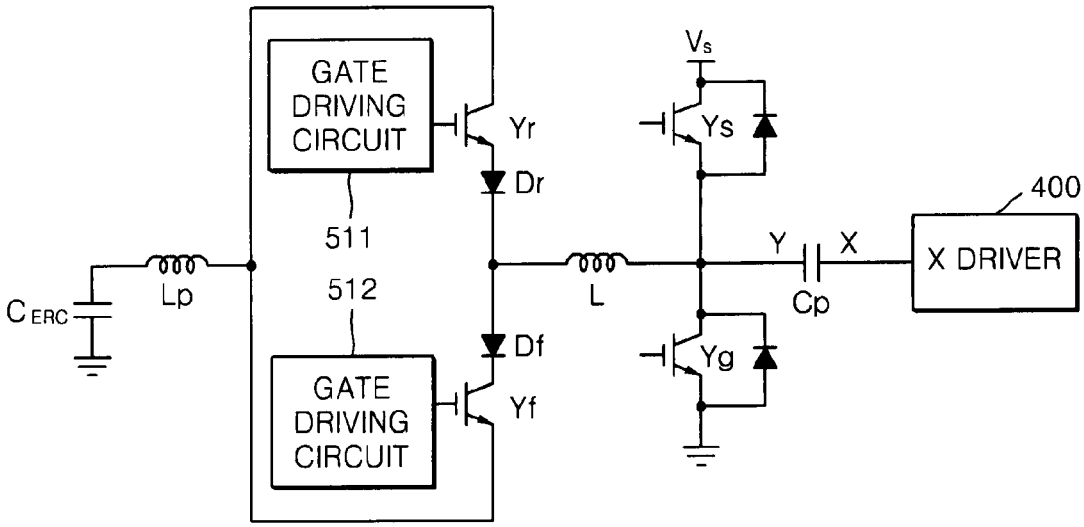
FIG. 5 is a circuit diagram including a parasitic inductance formed in the sustain discharge circuit of FIG. 3.
Figure 6:
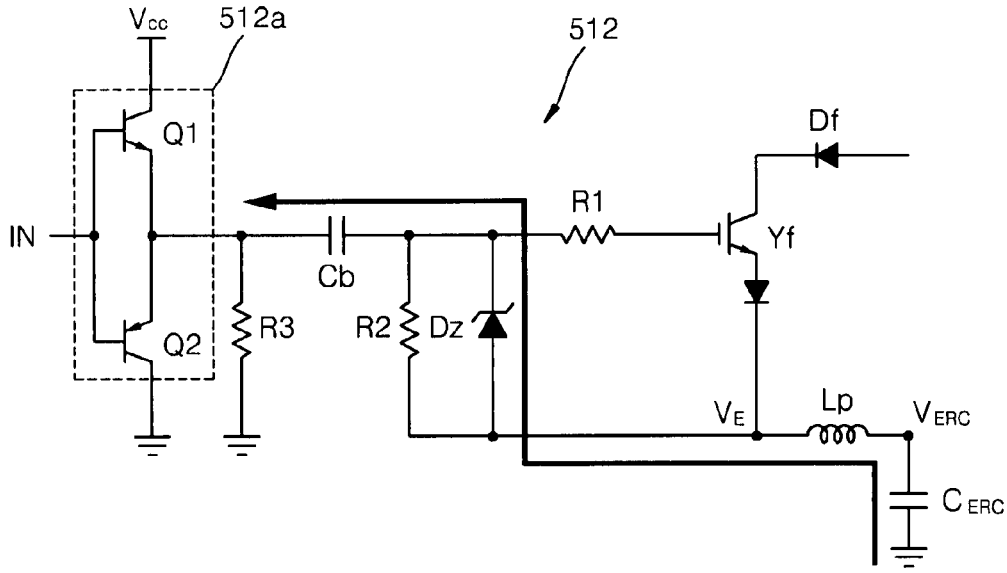
FIG. 6 is a circuit diagram of a gate drive circuit.

FIG. 5 is a circuit diagram including a parasitic inductance formed in the sustain discharge circuit 510 of FIG. 3. FIG. 6 is a circuit diagram of a gate drive circuit 512.

Referring to FIG. 5, a conductive pattern connecting the capacitor Cerc and the transistors Yr and Yf is increased due to a heatsink formed on the transistors Yr and Yf that constitute the resonance path in the sustain discharge circuit 510. The increased length of the conductive pattern can result in the parasitic inductance Lp between the transistors Yr and Yf and the capacitor Cerc. Gate drive circuits 511 and 512 are respectively connected to the transistors Yr and Yf. The transistor Yf that reduces the voltage of the Y electrode Y and the gate drive circuit 512 connected to the transistor Yf are shown in FIG. 6.

Referring to FIG. 6, the gate drive circuit 512 includes a push-pull circuit 512*a*, a capacitor Cb, resistors R1, R2, and R3, and a diode Dz. The push-pull circuit 512*a* includes an npn type transistor Q1 and a pnp type transistor Q2. The two transistors Q1 and Q2 both include a collector and emitter as two terminals, and a base used as a control terminal. The capacitor Cb serves as a bypass capacitor.

In the push-pull circuit 512*a*, a control signal IN is input into the base of the two transistors Q1 and Q2. A high level power source (e.g., Vcc) is connected to the collector of the npn type transistor Q1. A low level power source (e.g., 0V) is connected to the collector of the pnp type transistor Q2. The emitters of the two transistors Q1 and Q2 form an output terminal of the push-pull circuit 512*a*, and are connected to the gate of the transistor Yf through the capacitor Cb and the resistor R1. That is, a first terminal of the capacitor Cb is connected to the emitters of the two transistors Q1 and Q2, and the resistor R1 is connected to a second terminal of the capacitor Cb and the gate of the transistor Yf. The resistor R2 and the diode Dz are connected in parallel between the second terminal of the capacitor Cb and the emitter of the transistor Yf. The resistor R3 is connected between the first terminal of the capacitor Cb and the low level power source supplying 0V. If the transistor Yf is a FET, the resistor R2 and the diode Dz are connected in parallel between the second terminal of the capacitor Cb and source of the transistor Yf.

If the control signal IN has the low level power supplied to the gate drive circuit 512, the transistor Q2 is turned on so that a first terminal voltage of the capacitor Cb is 0V. An emitter voltage $V_E$ of the transistor Yf is charged in the capacitor Cb through a path connecting the emitter of the transistor Yf, the diode Dz, and the capacitor Cb. Since a second terminal voltage of the capacitor Cb, i.e., a gate voltage of the transistor Yf, is $V_E$, a gate-emitter voltage $V_{GE}$ of the transistor Yf is 0V and therefore the transistor Yf is turned off.

If the control signal IN has the high level voltage, the transistor Q1 is turned on so that the first terminal voltage of the capacitor Cb is Vcc. A second terminal voltage of the capacitor Cb is boosted by Vcc and then is a sum of Vcc and $V_E$. Therefore, the gate-emitter voltage $V_{GE}$ of the transistor Yf is Vcc so that the transistor Yf is turned on. Vcc is 15 volts, for example.

In order to prevent the gate voltage of the transistor Yf from increasing to more than a predetermined voltage due to a ripple of the capacitor Cb, the diode Dz can be a Zener diode Dz as illustrated in FIG. 5. In more detail, the Zener diode Dz can be used to clamp the gate-emitter voltage $V_{GE}$ of the transistor Yf below a breakdown voltage Vz of the Zener Diode Dz. The resistors R1, R2, and R3 are used to charge the capacitor Cb or constitute a discharge path, and can be removed as occasion demands.

Figure 7:
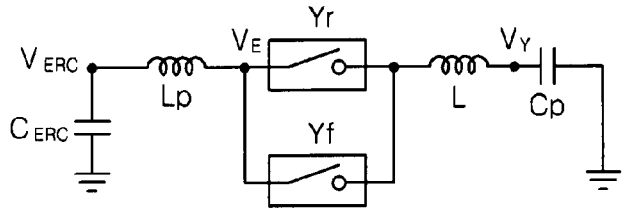
FIG. 7 is a circuit diagram model of a resonance path in the sustain discharge circuit of FIG. 3.
Figure 8:
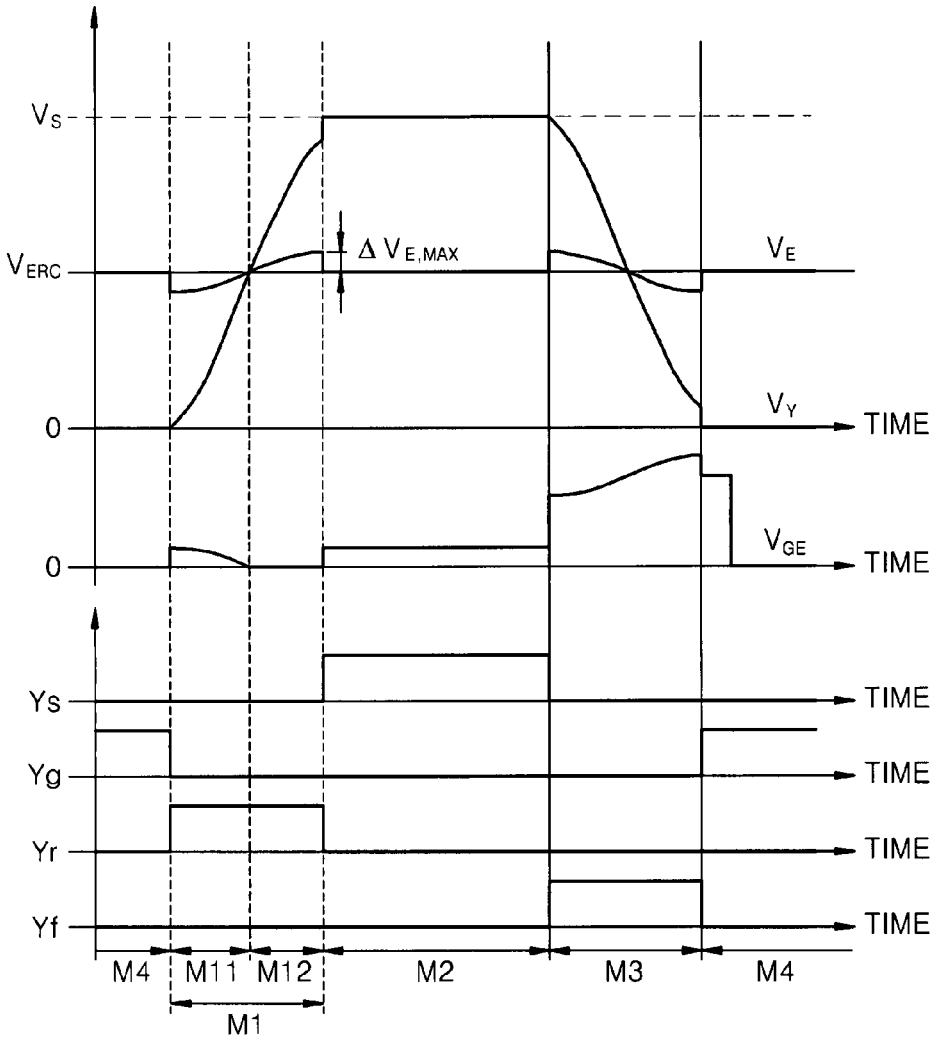
FIG. 8 includes waveforms of voltage variances due to a parasitic inductance in the sustain discharge circuit of FIG. 3.
Figure 9:
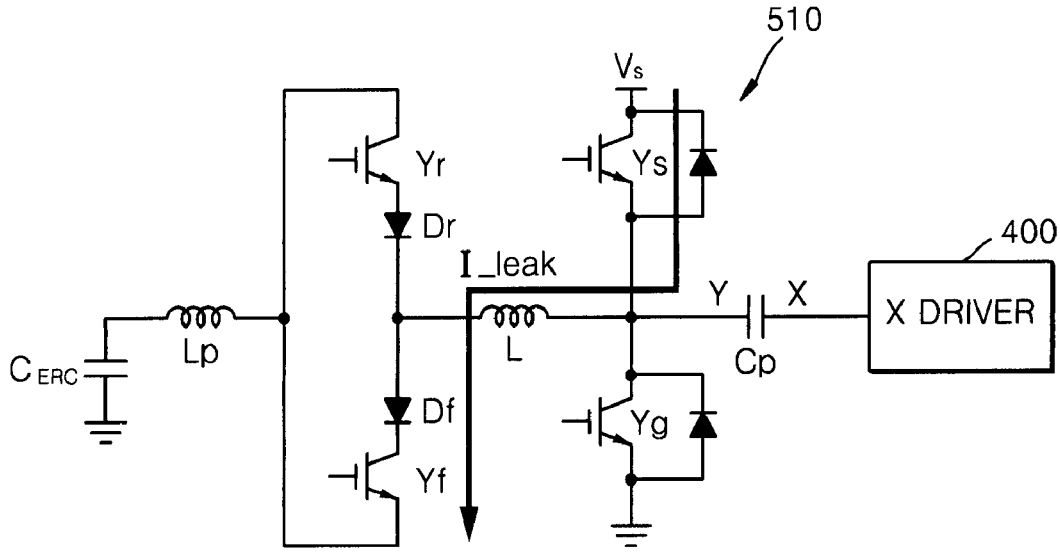
FIG. 9 is a circuit diagram of a current path caused by a malfunction in a transistor.

The malfunction of the gate drive circuit 512 due to the parasitic inductance Lp is described as follows with reference to FIGS. 7 through 9. FIG. 7 is a circuit diagram modeling a resonance path in the sustain discharge circuit 510 of FIG. 3. FIG. 8 is a graph illustrating voltage variances due to the parasitic inductance in the sustain discharge circuit 510 of FIG. 3. FIG. 9 is a circuit diagram of a current path caused by the malfunction of the transistor Yf.

Referring to FIG. 7, in a period M1 where the voltage of the Y electrode Y increases (hereinafter referred to as an "increase period"), as illustrated in FIG. 8, a resonance path connecting the capacitor Cerc, the parasitic inductance Lp, the transistor Yr, the inductor L, and the panel capacitor Cp is formed. A voltage of the point between the parasitic inductance Lp and the transistor Yf is the emitter voltage $V_E$ of the transistor Yf.

In the period M1 illustrated in FIG. 8 during which the voltage of the Y electrode Y increases, the parasitic inductance Lp involves a resonance between the inductor L and the panel capacitor Cp. Therefore, a voltage $\Delta V_E$ supplied to both ends of the parasitic inductance Lp is expressed by Equation 1. In more detail, the emitter voltage $V_E$ increases from a negative voltage to 0V if the voltage $V_Y$ of the Y electrode Y increases to $V_{ERC}$ in an initial increase period M11, and the emitter voltage $V_E$ increases from 0V to a positive voltage in a latter increase period M12

$$\Delta V_E = V_E - V_{ERC} = \frac{L_P}{L + L_P}(V_Y - V_{ERC}) \quad \text{Equation 1}$$

If the emitter voltage $V_E$ increases higher than $V_{ERC}$ in the latter increase period M12, the capacitor Cb is charged with a voltage higher than $V_{ERC}$ through the diode Dz as illustrated in FIG. 6. That is, the capacitor Cb can be charged up to the maximum voltage ($\Delta V_{E,MAX}$ in FIG. 8) of the emitter voltage $V_E$.

The transistor Yr is turned off in the mode 2 M2 so that no current flows through the capacitor Cerc. Therefore, a voltage does not drop in the parasitic inductance Lp so that the emitter voltage $V_E$ of the transistor Yr and the voltage $V_{ERC}$ of the capacitor $C_{ERC}$ can be identical to each other. However, the voltage of the capacitor Cb that is additionally charged by $\Delta V_{E,MAX}$ is gradually reduced through the resistor R2. Therefore, the gate-emitter voltage $V_{GE}$ of the transistor Yf can be increased to $\Delta V_{E,MAX}$. For example, if the voltage $V_{ERC}$ of the capacitor $C_{ERC}$ is Vs/2, $\Delta V_{E,MAX}$ is expressed by Equation 2.

$$\Delta V_{E,MAX} = \frac{L_P}{L + L_P}\frac{V_S}{2} \quad \text{Equation 2}$$

Since the Vs voltage is usually about 200V, although the size of the parasitic inductance Lp is below 1/10 of the inductor L, $\Delta V_{E,MAX}$ is several volts. Therefore, $\Delta V_{E,MAX}$ is similar to a threshold voltage of the transistor Yf so that the transistor Yf can be slightly turned on in the mode 2 M2. Then, a current I_leak can flow via a path of the power source Vs, the transistor Ys, the inductor L, the diode Df, the transistor Yf, and the capacitor $C_{ERC}$ in the mode 2 M2 as illustrated in FIG. 9. That is, a leakage current I_leak flowing through the transistor Yf raises an operation temperature of the transistor Yf in the mode 2 M2. The raised operation temperature of the transistor Yf reduces the threshold voltage of the transistor Yf so that leakage current I_leak flowing through the transistor Yf gradually increases. Therefore, the transistor Yf overheats and can be damaged.

Figure 10:
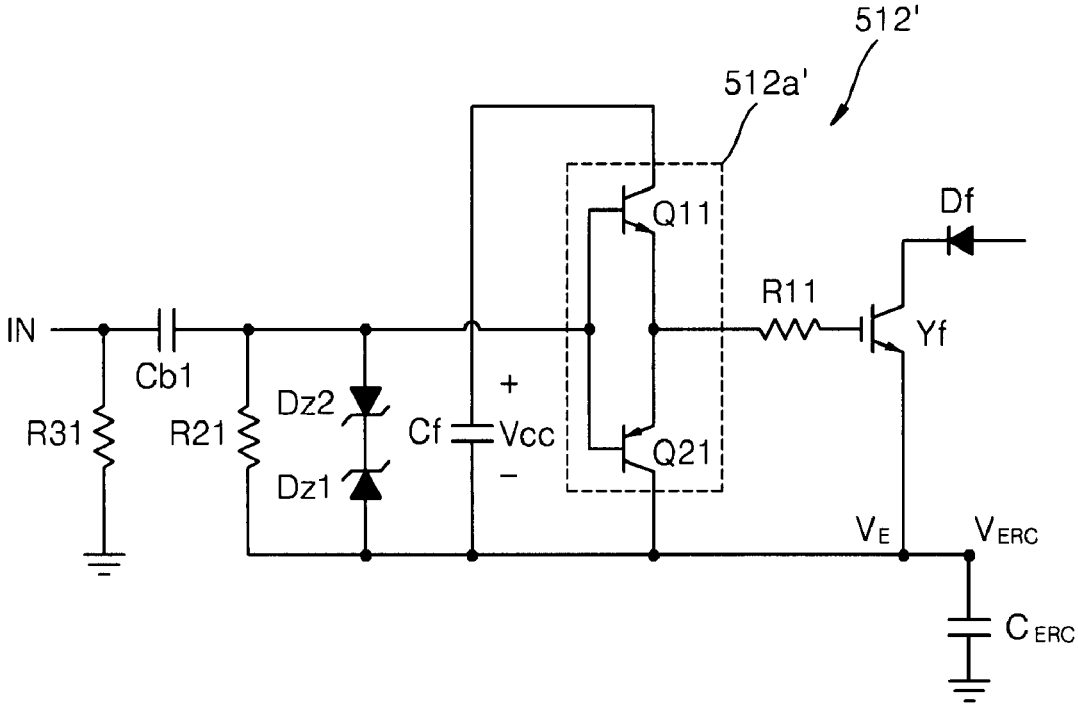
FIGS. 10 and 11 are circuit diagrams of gate drive circuits according to an embodiment of the present invention.

An embodiment of the present invention for preventing the malfunction of the transistor Yf is described in detail below with reference to FIG. 10. FIG. 10 is a circuit diagram of a gate drive circuit 512' according to an embodiment of the present invention.

Referring to FIG. 10, the gate drive circuit 512' of the present embodiment is different from the gate drive circuit 512 of FIG. 6 in terms of the location of a bypass capacitor Cb1 and a push-pull circuit 512*a*', and further comprises a floating power source Cf and Zener diode Dz2 in comparison with the gate drive circuit 512 of FIG. 6.

In more detail, the control signal IN is supplied to a first terminal of the bypass capacitor Cb1, and a second terminal of the bypass capacitor Cb1 is connected to bases of two transistors Q11 and Q21 which form an input terminal of the push-pull circuit 512*a*'. Emitters of the two transistors Q11 and Q21 which form an output terminal of the push-pull circuit 512*a*' are connected to the gate of the transistor Yf, and a collector of the transistor Q21 is connected to the emitter of the transistor Yf.

An anode of the Zener diode Dz2 is connected to the second terminal of the bypass capacitor Cb1, and a cathode of the Zener diode Dz2 is connected to a cathode of diode Dz 1. In more detail, the Zener diode Dz2 and the diode Dz1 are serially connected between the second terminal of the bypass capacitor Cb1 and the emitter of the transistor Yf. When an emitter voltage of the transistor Yf is higher than a second terminal voltage of the bypass capacitor Cb1, the diode Dz1 is connected in a forward-biased direction and the Zener diode Dz2 is connected in a reverse-biased direction. The location of the Zener diode Dz2 and the Zener diode Dz1 can be switched. In more detail, the anode of the Zener diode Dz2 is connected to the anode of the diode Dz1, and the cathode of the Zener diode Dz2 is connected to the emitter of the transistor Yf.

When the emitter voltage $V_E$ of the transistor Yf is higher than $V_{ERC}$ in the period M2 illustrated in FIG. 8, the emitter voltage $V_E$ is charged to the bypass capacitor Cb1 through the diode Dz1 and the Zener diode Dz2. Therefore, a voltage that is reduced by a breakdown voltage of the Zener diode Dz2 due to the emitter voltage $V_E$ charges the bypass capacitor Cb1. Therefore, the gate-emitter voltage $V_{GE}$ of the transistor Yf in the period M2 illustrated in FIG. 8 is reduced and thus the transistor Yf is not turned off, thereby preventing a malfunction in the transistor Yf.

A negative terminal of the floating power source Cf is connected to an emitter of the transistor Yf, i.e., the collector of the transistor Q21, and a positive terminal of the floating power source Cf is connected to the collector of the transistor Q11. In more detail, the positive terminal of the floating power source Cf is connected to a high level power terminal of the push-pull circuit 512*a*', and the negative terminal of the floating power source Cf is connected to a low level power terminal of the push-pull circuit 512*a*'. A voltage of the negative terminal and positive terminal of the floating power source Cf is Vcc.

Like the gate drive circuit 512 of FIG. 6, a resistor R11 is connected between an output terminal of the push-pull circuit 512*a*' and the gate of the transistor Yf. A resistor R21 is connected between the second terminal of the bypass capacitor Cb1 and the emitter of the transistor Yf. A resistor R31 is connected between the first terminal of the capacitor Cb1 and the low level power terminal. The diode Dz1 can be a Zener diode as illustrated in FIG. 10.

In the gate drive circuit 512', if the control signal IN has a low level voltage 0V, a $V_{ERC}$ voltage that is the emitter voltage $V_E$ of the transistor Yf charges the bypass capacitor Cb1 through a path connecting the emitter of the transistor Yf, the Zener diode Dz2, the diode Dz1, and the bypass capacitor Cb1. The input terminal voltage of the push-pull circuit 512*a*' is the same as a low level power voltage of the push-pull circuit 512*a*' so that the transistor Q21 is turned on. Therefore, the gate-emitter voltage $V_{GE}$ of the transistor Yf is 0V and thus the transistor Yf is turned off.

If the control signal IN has a low level, the low level voltage is supplied to the first terminal of the bypass capacitor Cb1 so that the transistor Yf is turned off. The emitter voltage of the transistor Yf is reduced by a breakdown voltage of the Zener diode Dz2 due to the diode Dz1 and the Zener diode Dz2 and supplied to the second terminal of the bypass capacitor Cb1. Therefore, although the emitter voltage of the transistor Yf increases higher than a desired voltage, the transistor Yf cannot suffer a malfunction.

If the control signal IN has a high level voltage Vcc, the second terminal voltage of the bypass capacitor Cb1 is the sum of the $V_{ERC}$ voltage and Vcc voltage so that the transistor is turned on. Since a negative voltage of the floating power source Cf is the $V_{ERC}$ voltage, a positive voltage of the floating power source Cf is the sum of the $V_{ERC}$ voltage and Vcc voltage. The sum ($V_{ERC}$+Vcc) voltage is supplied to the gate of the transistor Yf through the transistor Q21 so that the transistor Yf can be turned on.

If the control signal IN has a high level, a first terminal voltage of the bypass capacitor Cb1 is the high level voltage Vcc. Therefore, the second terminal voltage of the bypass capacitor Cb1 that is boosted by the high level voltage Vcc is input into the bases of the two transistors Q11 and Q21 that form the input terminal of the push-pull circuit 512*a*'.

As described above, although the second terminal voltage of the bypass capacitor Cb1 is lower than the sum ($V_{ERC}$+Vcc) voltage due to a voltage drop or the parasitic component in the bypass capacitor Cb1, the transistor Q21 is a bipolar junction transistor having a low threshold voltage and thus can be properly turned on.

According to the present embodiment, although the second terminal voltage of the bypass capacitor Cb1 is lower than a desired voltage due to the voltage drop in the conductive pattern or the parasitic component of the bypass capacitor Cb1, the transistor Yf can be properly turned on.

Figure 11:
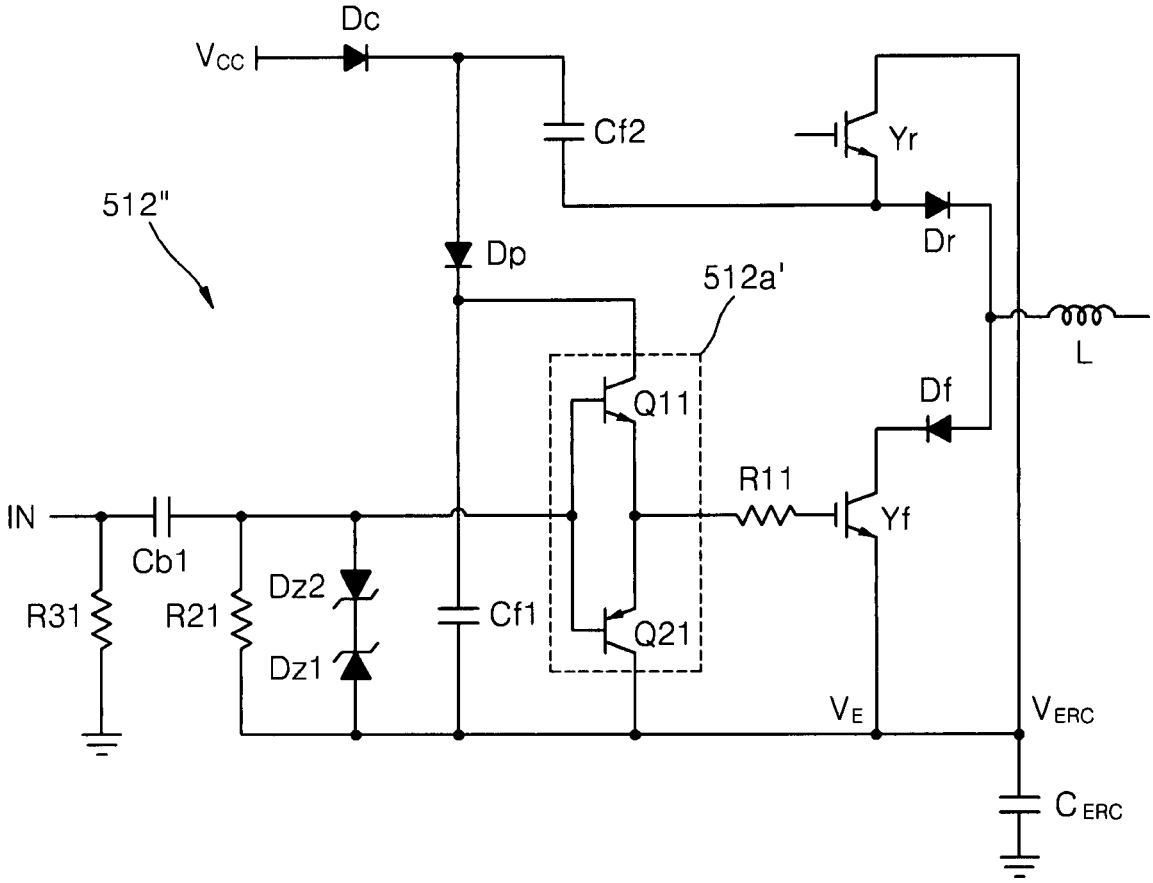

Another embodiment of the gate drive circuit including the floating power source Cf illustrated in FIG. 10 is described below with reference to FIG. 11. FIG. 11 is a circuit diagram of a gate drive circuit 512" according to another embodiment of the present invention.

Referring to FIG. 11, the gate drive circuit 512" of the present embodiment includes capacitors Cf1 and Cf2 and diodes Dp and Dc instead of the floating power source Cf of the gate drive circuit 512' of FIG. 10.

A first terminal of the capacitor Cf1 is connected to a collector of the transistor Q21. A second terminal of the capacitor Cf2 is connected to a collector of the transistor Q11. A first terminal of the capacitor Cf2 is connected to a power source supplying a voltage Vcc and the second terminal of the capacitor Cf1. The second terminal of the capacitor Cf2 serves as a positive terminal of the floating power source. The first terminal of the capacitor Cf1 serves as a negative terminal of the floating power source.

An anode of the Zener diode Dz2 is connected to the second terminal of the bypass capacitor Cb1. A cathode of the Zener diode Dz2 is connected to the cathode of the diode Dz1. In more detail, the Zener diode Dz2 and the diode Dz1 are serially connected between the second terminal of the bypass capacitor Cb1 and the emitter of the transistor Yf. When the emitter voltage of the transistor Yf is higher than the second terminal voltage of the bypass capacitor Cb1, the diode Dz1 is connected in a forward-biased direction, and the Zener diode Dz2 is connected in a reverse-biased direction. The location of the Zener diode Dz2 and the diode Dz1 can be switched. That is, the anode of the Zener diode Dz2 is connected to the anode of the diode Dz1, and the cathode of the Zener diode Dz2 is connected to the emitter of the transistor Yf.

When the emitter voltage $V_E$ of the transistor Yf is higher than $V_{ERC}$ in the period M2 illustrated in FIG. 8, the emitter voltage $V_E$ charges the bypass capacitor Cb1 through the diode Dz1 and the Zener diode Dz2. Therefore, a voltage that is reduced by a breakdown voltage of the Zener diode Dz2 from the emitter voltage $V_E$ charges the bypass capacitor Cb1. Therefore, the gate-emitter voltage $V_{GE}$ of the transistor Yf in the period M2 illustrated in FIG. 8 is reduced and thus the transistor Yf is not turned off, thereby preventing a malfunction in the transistor Yf.

Referring to FIGS. 3 and 4, when the transistor Yg is turned on in mode 4 M4, since 0V is supplied to the Y electrode Y, the emitter voltage of the transistor Yr is 0V. Therefore, the second terminal voltage of the capacitor Cf2 is 0V, and Vcc voltage charges the capacitor Cf.

When the transistor Yr is turned on in mode 1 M1, since the emitter voltage of the transistor Yr is $V_{ERC}$, the second terminal voltage of the capacitor Cf2 is $V_{ERC}$. The first terminal voltage of the capacitor Cf2 is boosted by the $V_{ERC}$ voltage and then Vcc+$V_{ERC}$ voltage. The Vcc+$V_{ERC}$ voltage is supplied to the second terminal of the capacitor Cf1. The first terminal voltage of the capacitor Cf1 is $V_{ERC}$ voltage, and Vcc voltage charges the capacitor Cf1.

The control signal IN has a low level voltage in modes 1, 2, and 4 M1, M2, and M4. As described above, the $V_{ERC}$ voltage charges the bypass capacitor Cb1. Since the control signal is low level, a low level voltage is supplied to the first terminal of the bypass capacitor Cb1 so that the transistor Yf is turned off.

The emitter voltage of the transistor Yf is reduced by a breakdown voltage of the Zener diode Dz2 due to the diode Dz1 and the Zener diode Dz2 and supplied to the second terminal of the bypass capacitor Cb1. Therefore, the emitter voltage $V_E$ charges the bypass capacitor Cb1. Therefore, although the emitter voltage of the transistor Yf increases to a level higher than a desired voltage level, the transistor Yf cannot suffer a malfunction.

The control signal IN has a high level voltage Vcc in the mode 3 M3. As described above, the transistor Q21 is turned on by the second terminal voltage of the bypass capacitor Cb1. Therefore, the second terminal voltage of the capacitor Cf1, i.e., the sum of $V_{ERC}$ voltage and Vcc voltage, is supplied to the gate of the transistor Yf and thus the transistor Yf is turned on.

If the control signal IN has a high level, the first terminal voltage of the bypass capacitor Cb1 is the high level voltage Vcc. Therefore, the second terminal voltage of the bypass capacitor Cb1 that is boosted by the high level voltage Vcc is input into the bases of the two transistors Q11 and Q21 that form the input terminal of the push-pull circuit 512*a*".

Referring to FIG. 11, a diode Dp can be inserted into the circuit in order to block a current path from the second terminal of the capacitor Cf1 to the first terminal of the capacitor Cf2, and a diode Dc can be inserted into the circuit in order to block a current path from the first terminal of the capacitor Cf2 to the power Vcc. In more detail, an anode of the diode Dp is connected to the first terminal of the capacitor Cf2, and a cathode of the diode Dp is connected to the first terminal of the capacitor Cf1. An anode of the diode Dc is connected to the power source supplying Vcc, and a cathode of the diode Dc can be connected to the first terminal of the capacitor Cf2.

In the gate drive circuit 512 of FIG. 6, a conductive pattern connecting the capacitor Cb and the resistor R1 can be increased due to the resistor R2, the diode Dz, and the like. A parasitic component formed in the conductive pattern causes a drop in voltage so that the second terminal voltage of the capacitor Cb can be supplied to the gate of the transistor Yf.

When the first terminal voltage of the capacitor Cb increases from 0V voltage to Vcc voltage, the second terminal voltage of the capacitor Cb cannot sufficiently increase from the $V_{ERC}$ voltage to the ($V_{ERC}$+Vcc) voltage due to the parasitic component formed in the capacitor Cb. Therefore, a voltage lower than the ($V_{ERC}$+Vcc) voltage is supplied to the gate of the transistor Yf so that the transistor Yf cannot be turned on.

Figure 12:
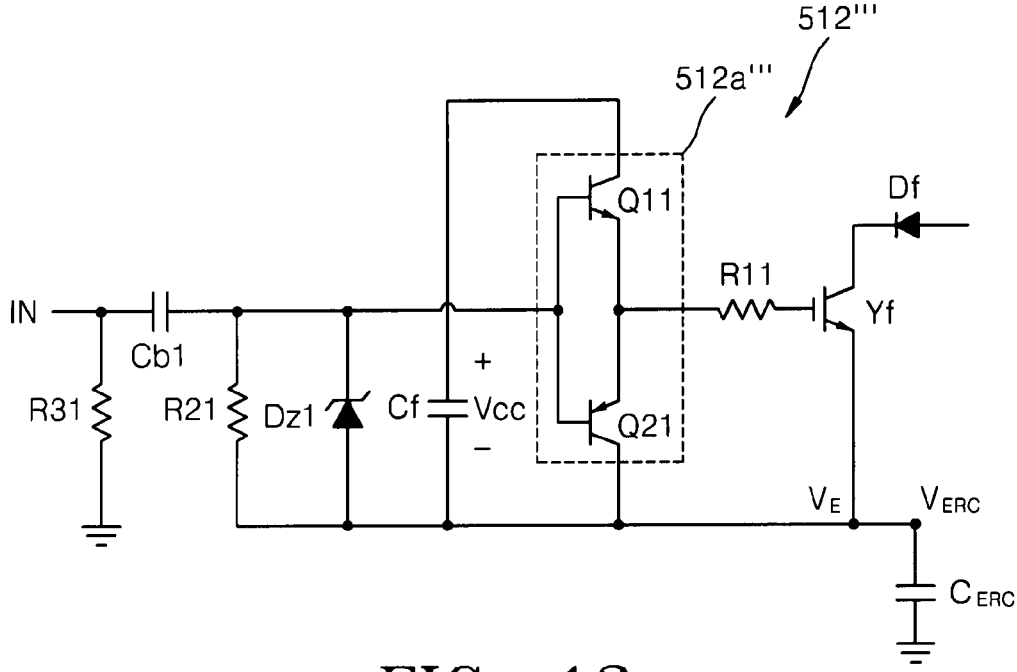
FIGS. 12 and 13 are circuit diagrams of gate drive circuits according to another embodiment of the present invention.
Figure 13:
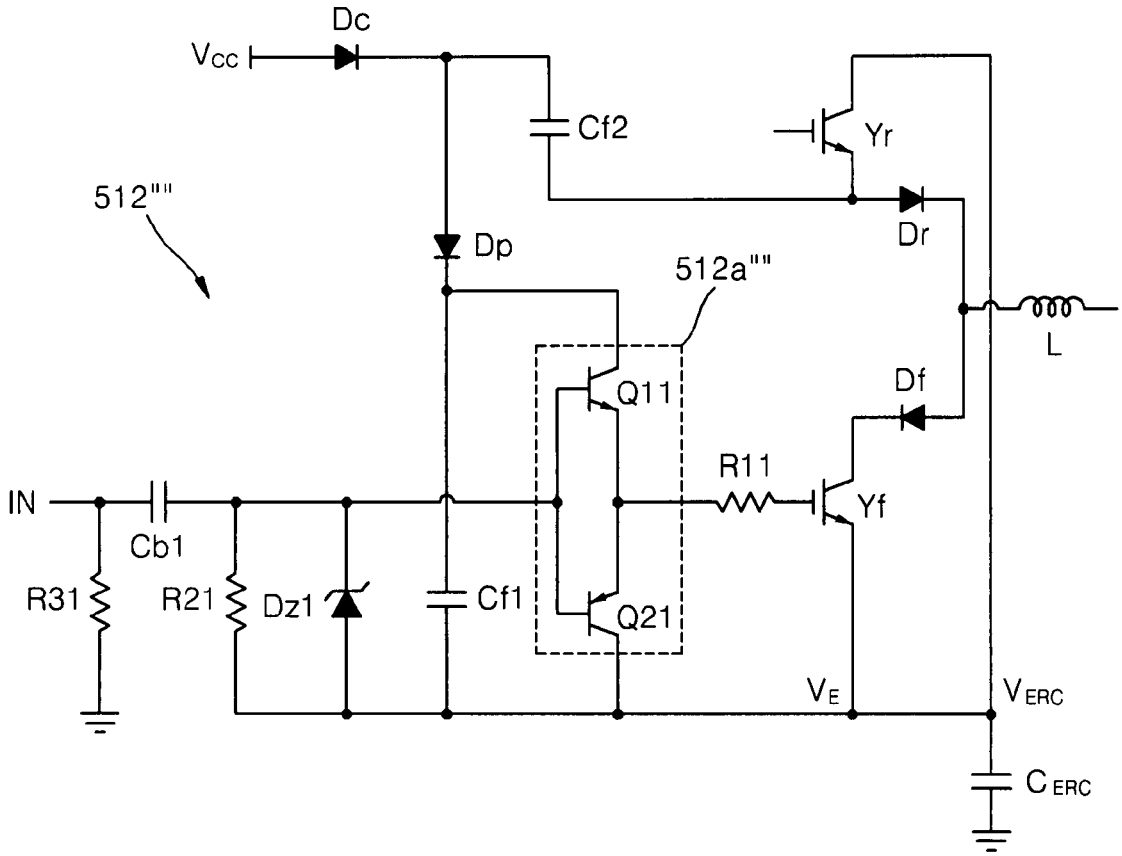

FIGS. 12 and 13 are circuit diagrams of gate drive circuits 512''' and 512'''' that prevent the transistor Yf from being turned off according to another embodiment of the present invention.

Referring to FIG. 12, the gate drive circuit 512''' differs from the gate drive circuit 512 of FIG. 6 in terms of the location of a bypass capacitor Cb1 and a push-pull circuit 512*a*''', and further includes a floating power source Cf in comparison with the gate drive circuit 512 of FIG. 6. Furthermore, the gate drive circuit 512''' does not include the Zener diode Dz2 of FIG. 10.

In the gate drive circuit 512''', if a control signal IN has a low level voltage 0V, a $V_{ERC}$ voltage that is an emitter voltage $V_E$ of the transistor Yf charges the bypass capacitor Cb1 through a path connecting an emitter of the transistor Yf, a diode Dz1, and the bypass capacitor Cb1. An input terminal voltage of the push-pull circuit 512*a*' ' ' is the same as a low level power voltage of the push-pull circuit 512*a*''' so that a transistor Q12 is turned on. Therefore, a gate-emitter voltage $V_{GE}$ of the transistor Yf is 0V and thus the transistor Yf is turned off.

If the control signal IN has a high level voltage Vcc, a second terminal voltage of the bypass capacitor Cb1 is the sum of the $V_{ERC}$ voltage and Vcc voltage so that the transistor Q12 is turned on. Since a negative voltage of the floating power source Cf is the $V_{ERC}$ voltage, a positive voltage of the floating power source Cf is the sum of the $V_{ERC}$ voltage and Vcc voltage. The sum ($V_{ERC}$+Vcc) voltage is supplied to the gate of the transistor Yf through the transistor Q12 so that the transistor Yf can be turned on. As described above, although the second terminal voltage of the bypass capacitor Cb1 is lower than the sum ($V_{ERC}$+Vcc) voltage due to a voltage drop or the parasitic component in the bypass capacitor Cb1, the transistor Q12 is a bipolar junction transistor having a low threshold voltage and thus can be properly turned on.

According to the present embodiment, although the second terminal voltage of the bypass capacitor Cb1 is lower than a desired voltage due to the voltage drop in the conductive pattern or the parasitic component of the bypass capacitor Cb1, the transistor Yf can be properly turned on.

Another embodiment of the gate drive circuit 512'''' including the floating power source Cf of FIG. 12 is described below with reference to FIG. 13. FIG. 13 is a circuit diagram of the gate drive circuit 512'''' according to another embodiment of the present invention.

Referring to FIG. 13, the gate drive circuit 512'''' of the present embodiment c includes capacitors Cf1 and Cf2 and diodes Dp and Dc instead of the floating power source Cf of the gate drive circuit 512''' of FIG. 12.

In the gate drive circuit 512'''' of the present embodiment, a control signal IN has a low level voltage in modes 1, 2, and 4 M1, M2, and M4 as illustrated in FIG. 12. As described above, the $V_{ERC}$ voltage charges a bypass capacitor Cb1.

The control signal IN has a high level voltage Vcc in the mode 3 M3. As described above, a transistor Q12 is turned on by the second terminal voltage of the bypass capacitor Cb1. Therefore, the second terminal voltage of the capacitor Cf1, i.e., the sum of $V_{ERC}$ voltage and Vcc voltage, is supplied to the gate of the transistor Yf and thus the transistor Yf is turned on.

According to the present embodiment, although the second terminal voltage of the bypass capacitor Cb1 is lower than a desired voltage due to the voltage drop in the conductive pattern or the parasitic component of the bypass capacitor Cb1, the transistor Yf can be properly turned on.

In the embodiments of the present invention, the gate drive circuits 512', 512'', 512''', and 512'''' are connected to the gate of the transistor Yf. However, the gate drive circuits 512', 512'', 512''', and 512'''' can be connected to a gate of another transistor and a gate of a transistor used in an apparatus other than a plasma display apparatus. In the present embodiment, a push-pull circuit is used to supply a voltage to a gate of a transistor. However, another amplifier having a similar function to the push-pull circuit can be used.

According to the plasma display apparatus of the present invention, a sustain discharge circuit including an energy recovery circuit can prevent a malfunction in transistors that reduce the voltage of an electrode.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. A plasma display apparatus comprising:

an electrode of a discharge cell;

a first transistor having a first terminal and a second terminal, the second terminal being connected to the electrode;

a first capacitor having a first terminal to receive a control signal having either a low level voltage or a high level voltage;

a push-pull circuit including a first power terminal, a second power terminal connected to the first terminal of the first transistor, an input terminal connected to a second terminal of the first capacitor, and an output terminal connected to a gate of the first transistor, the push-pull circuit outputting either a voltage of the first power terminal or a voltage of the second power terminal to the output terminal;

a floating power source having a positive terminal connected to the first power terminal and a negative terminal connected to the second power terminal; and a first diode connected between the first terminal of the first transistor and the second terminal of the first capacitor.

2. The plasma display apparatus of claim 1, further comprising a second diode serially connected to the first diode in an opposite direction to the first diode, the second diode being a Zener diode.

3. The plasma display apparatus of claim 2, wherein the first diode is a Zener diode.

4. The plasma display apparatus of claim 3, wherein an anode of the first diode is connected to the first terminal of the first transistor, a cathode of the first diode is connected to a cathode of the second diode, and an anode of the second diode is connected to the second terminal of the first capacitor.

5. The plasma display apparatus of claim 2, further comprising:

a first resistor connected between the output terminal of the push-pull circuit and the gate of the first transistor;

a second resistor connected between the second terminal of the first capacitor and the first terminal of the first transistor; and a third resistor connected between the first terminal of the first capacitor and a ground terminal.

6. The plasma display apparatus of claim 2, wherein the push-pull circuit comprises:

an npn type transistor including a collector connected to the first power terminal, an emitter connected to the output terminal, and a base connected to the input terminal; and a pnp type transistor including a collector connected to the second power terminal, an emitter connected to the output terminal, and a base connected to the input terminal.

7. The plasma display apparatus of claim 2, wherein the first transistor is an Insulated Gate Bipolar Transistor (IGBT) and the first terminal of the first transistor is an emitter.

8. The plasma display apparatus of claim 2, wherein the first transistor is a Field Effect Transistor (FET), and the first terminal of the first transistor is a source.

9. The plasma display apparatus of claim 2, further comprising:

a second capacitor connected to the first terminal of the first transistor;

an inductor connected between the electrode and the second terminal of the first transistor;

a second transistor having a first terminal connected to the inductor and a second terminal connected to the second capacitor;

a third transistor connected between the electrode and a first power source, the first power source supplying a first voltage; and a fourth transistor connected between the electrode and a second power source, the second power source supplying a second voltage lower than the first voltage.

10. A plasma display apparatus comprising:

an electrode of a discharge cell;

a first transistor having a second terminal connected to the electrode;

a first capacitor having a first terminal to receive a control signal having either a low level voltage or a high level voltage;

a push-pull circuit including a first power terminal, a second power terminal connected to a first terminal of the first transistor, an input terminal connected to a second terminal of the first capacitor, and an output terminal connected to a gate of the first transistor, the push-pull circuit outputting either a voltage of the first power terminal or the second power terminal at the output terminal;

a floating power source having a positive terminal connected to the first power terminal and a negative terminal connected to the second power terminal;

a first diode connected between the first terminal of the first transistor and the second terminal of the first capacitor;

an inductor connected between the electrode and the second terminal of the first transistor;

a second transistor having a first terminal connected to the inductor and a second terminal connected to the first capacitor; and a third capacitor having a first terminal connected to a third power source and a second terminal connected to the first terminal of the second transistor, the third power source supplying a third voltage.

11. The plasma display apparatus of claim 10, further comprising a second diode serially connected to the first diode in an opposite polarity to the first diode, the second diode being a Zener diode.

12. The plasma display apparatus of claim 10, wherein the floating power source comprises a fourth capacitor having a first terminal connected to the second power terminal and a second terminal connected to the first power terminal and the first terminal of the third capacitor.

13. The plasma display apparatus of claim 10, wherein the first diode is a Zener diode.

14. The plasma display apparatus of claim 13, wherein an anode of the first diode is connected to the first terminal of the first transistor, a cathode of the first diode is connected to a cathode of the second diode, and an anode of the second diode is connected to the second terminal of the first capacitor.

15. The plasma display apparatus of claim 11, further comprising:

a first resistor connected between the output terminal of the push-pull circuit and the gate of the first transistor;

a second resistor connected between the second terminal of the first capacitor and the first terminal of the first transistor; and a third resistor connected between the first terminal of the first capacitor and a ground terminal.

16. The plasma display apparatus of claim 11, wherein the push-pull circuit comprises:

an npn type transistor including a collector connected to the first power terminal, an emitter connected to the output terminal, and a base connected to the input terminal; and a pnp type transistor including a collector connected to the second power terminal, an emitter connected to the output terminal, and a base connected to the input terminal.

17. The plasma display apparatus of claim 11, wherein the first transistor is an Insulated Gate Bipolar Transistor (IGBT) and the first terminal of the first transistor is an emitter.

18. The plasma display apparatus of claim 11, wherein the first transistor is a Field Effect Transistor (FET) and the first terminal of the first transistor is a source.

19. The plasma display apparatus of claim 11, further comprising:

a second capacitor connected to the first terminal of the first transistor;

a third transistor connected between the electrode and a first power source, the first power source supplying a first voltage; and a fourth transistor between the electrode and a second power source, the second power source supplying a second voltage lower than the first voltage.

20. The plasma display apparatus of claim 19, further comprising:

a third diode connected between a first terminal of the third transistor and a second terminal of the fourth transistor; and a fourth diode connected between a third power source and the first terminal of the third transistor.

21. The plasma display apparatus of claim 20, further comprising:

a fifth diode having an anode connected to the inductor and a cathode connected to the second terminal of the first transistor; and a sixth diode having an anode connected to the first terminal of the second transistor and a cathode connected to the inductor.

* * * * *